US005690159A

United States Patent [19]

Mizukusa

[11] Patent Number: 5,690,159

[45] Date of Patent: Nov. 25, 1997

[54] CASTING APPARATUS AND CASTING METHOD FOR PRODUCING CYLINDER BLOCK

[75] Inventor: Yasuyuki Mizukusa, Fuchu, Japan

[73] Assignee: Ryobi Ltd., Hiroshima-Ken, Japan

[21] Appl. No.: 703,726

[22] Filed: Aug. 27, 1996

[30] Foreign Application Priority Data

Sep. 7, 1995 [JP] Japan ..... 7-255659

[51] Int. Cl.[6] ..... B22D 29/00

[52] U.S. Cl. ..... 164/132; 164/137; 164/340; 164/369

[58] Field of Search ..... 164/132, 137, 164/340, 369, 345, 346

[56] References Cited

FOREIGN PATENT DOCUMENTS

| | | | |
|---|---|---|---|
| 1-150429 | 6/1989 | Japan | 164/340 |
| 2-53623 | 11/1990 | Japan . | |
| 6-55251 | 3/1994 | Japan | 164/340 |

*Primary Examiner*—Kuang Y. Lin

*Attorney, Agent, or Firm*—Sughrue,Mion,Zinn,Macpeak & Seas, PLLC

[57] ABSTRACT

A casting apparatus and method for producing a closed deck type cylinder block capable of facilitating removal of loose cores from the casted cylinder block. A die portion for forming a water jacket portion is formed with a plurality of notched portion having a bottom wall where a projection is provided. A pair of loose cores are fitted in each notched portion in such a manner that each parting face of the loose cores are in contact with each other. A first draft is provided at each loose cores and is mounted on the projection. In this case, the end of the parting face is placed on the projection. During casting, a molten metal is introduced into a space between the bottom wall and the first draft for forming a bridge portion. Upon solidification of the molten metal, the loose cores remain in the water jacket portion, and a bore is formed at the position corresponding to the projection. If a jig is inserted into the bore, the end of the jig abuts the parting face and pushes the pair of loose cores to move away from each other. Thus, the loose cores are offset from the bridge portion for removal of the loose core from the water jacket portion.

10 Claims, 5 Drawing Sheets

CASTING APPARATUS AND CASTING METHOD FOR PRODUCING CYLINDER BLOCK

BACKGROUND OF THE INVENTION

The present invention relates to a casting apparatus and casting method for producing a cylinder block, and more particular to such apparatus and method using a plurality of loose cores.

A closed deck type cylinder block is known in which a bridge portion is provided bridging between an outer edge contour of a cylinder and a frame member surrounding the outer edge contour and to which a cylinder head is attached. In other words, an open end of a water jacket in the cylinder block is reinforced by the bridge portion, thereby reinforcing a top deck of the cylinder block to thus reduce engine vibration and reinforce the cylinder block.

The bridge portion provides an undercut portion at the open end of the water jacket. Therefore, a collapsible core or a metallic core having low melting point is used for casting the closed deck type cylinder block. That is, after casting, the core is collapsed or melted to remove the core material from the casted product. However, if such core is used, it would be difficult to completely remove the core material from the casted cylinder block, but the core material may remain in a space of the cylinder block.

Further, the collapsible core does not have high rigidity, and may be collapsed due to minute change in casting condition when high pressure casting or high speed injection is performed. Furthermore, manufacture and handling of the collapsible core may incur difficulty.

In order to overcome these drawbacks and to facilitate a manufacture of the closed deck type cylinder block, Japanese Patent Application Kokai No. Hei 1-110861 discloses an improved casting apparatus and method for casting the cylinder block. According to the apparatus, a rigid loose core is used, and FIG. 8(*a*) shows a part of the cylinder block 101 as viewed from an attachment frame 107, and FIG. 8(*b*) is a cross-sectional view taken along the line VIII—VIII of FIG. 8(*a*) for description of an order for removing the rigid loose core 126 from the casted cylinder block 101.

A metal mold die (not shown) for molding a cylinder block has a cylindrical protruding portion (not shown) for supporting a cylinder liner 111, and a die portion (not shown) for forming a water jacket portion 110. The die portion is formed with a plurality of notched portions extending in an axial direction of the cylinder liner 111. A loose core 126 is fittingly disposed in each notched portion of the die portion while maintaining a space (corresponding to a portion 106 in FIG. 8(*b*)) between the notched portion and the loose core 126. When a molten metal is entered into the space and is solidified, a bridge portion 106 is provided at the space.

The loose core 126 has a draft 126*a*, and therefore, the casted bridge portion 106 has a slant surface 106*a* corresponding to an inclination of the draft 126*a*, so that the loose core 126 can be easily removed from the water jacket 110 in a direction indicated by an arrow A in FIG. 8(*a*) and 8(*b*). That is, upon solidification of the molten metal, the metal mold die is moved away from the cylinder liner 111. In this case, the loose core 126 cannot be moved along with the movement of the metal mold die due to the mechanical interference with the casted bridge portion 106. Instead, the notched portion of the die portion is slidingly moved with respect to the loose core 126, so that the loose core 126 remains in the water jacket 110. Then, the loose core 126 is moved in the direction indicated by the arrow A within the water jacket 110 to avoid mechanical interference with the bridge portion 106 as shown by a two dotted chain line in FIG. 8(*b*). Then, the loose core 126 is pulled up in a direction indicated by an arrow B in FIG. 8(*b*). Thus, the loose core 126 is removed from the cylinder block. Because of the formation of the draft 126*a*, the loose core 126 can be easily moved in the direction A for facilitating the removal of the loose core.

According to the apparatus and method in the JP reference, the easiest way for moving the loose core 126 in the direction A is to initially apply a force directing an arrow C in FIG. 8(*b*) to an upper protruding part of the loose core 126. By this force application, the loose core 126 is moved in a counterclockwise direction in FIG. 8(*b*) about the casted bridge portion 106. However, when applying force to the upper protruding part, the loose core 126 is subjected to distorted or gouging force, and it would be difficult to move the loose core 126 in a generally circumferential direction of the water jacket 110. Further, the loose core 126 and the cylinder block 101 are damaged or injured, and high dimensional accuracy may not be obtained in the final product. Furthermore, if excessive rotational moment is exerted on the loose core 126, the casted bridge portion 106 may also be damaged or destroyed.

A tool may be inserted into the water jacket 110 so as to push an intermediate portion of the loose core 126 in a direction indicated by an arrow D in FIG. 8(*b*) in order to disengage the loose core 126 from the bridge portion 106. However, since the water jacket 110 provides a relatively narrow space, tool insertion may be difficult and the removal work may become troublesome.

SUMMARY OF THE INVENTION

It is therefore, an object of the present invention to overcome the conventional drawbacks and disadvantages and to provide an improved casting apparatus and casting method for producing a closed deck type cylinder block, the apparatus and method being capable of facilitating removal of a rigid loose core from the cylinder block and producing the cylinder block with high dimensional accuracy without any damage.

This and other objects of the present invention can be attained by providing a casting apparatus for producing a closed deck type cylinder block having a top deck portion and a plurality of juxtaposedly aligned cylinder liners, a water jacket portion being formed around the cylinder liners and having one open end open at the top deck portion, the open end being partly closed by a plurality of bridge portions provided at the top deck portion, the apparatus including a metal mold die and a plurality of pair of loose cores. The metal mold die is adapted for molding a substantial part of the cylinder block. The metal mold die has a die portion whose profile is the same as that of the water jacket portion for forming the water jacket portion. The die portion has a free end portion formed with a plurality of notched portions each having side walls extending in an axial direction of the cylinder liner and a bottom wall. Each pair of the loose cores are insertable into each notched portion, and each pair of loose cores have symmetrical shape and have parting faces extending in the axial direction of the cylinder liner. Each pair of loose cores have a first draft facing the bottom wall of the notched portion and a second draft which defines a part of a lower end of the water jacket portion. A distance between the first and second drafts in the axial direction of the cylinder liner is gradually increased toward opposite circumferential direction of the water jacket portion from the parting faces. With this arrangement, the separating loose cores can be easily moved within the water jacket portion without interference with the bridge portion. Therefore, the loose cores can be easily removed from the water jacket portion without damage to the casted product and without application of excessive force to the loose cores.

Preferrably, each pair of the loose cores have an outer slide draft at a radially outer side thereof in a radial direction of the cylinder liner and an inner slide draft at a radially inner side of the loose core in the radial direction of the cylinder liner. A distance between the first and second slide drafts defines a thickness of each pair of the loose cores in a radial direction of the cylinder liner. The thickness of each pair of the loose cores is gradually increased toward the opposite circumferential direction of the water jacket portion from the parting faces. With this arrangement, during movement of the loose cores within the water jacket portion, mechanical interference of the loose cores with the walls of the water jacket portion can be eliminated.

Further, in the preferable form, each bottom wall of each notched portion is formed with a projection for forming a bore portion at each bridge portion. The first draft of each pair of the loose cores is mounted on the projection in which an end of the parting faces are positioned on the projection. With this arrangement, upon solidification of a molten metal, the bridge portion has a bore at a position corresponding to the projection. If a jig is inserted into the bore, the tip end of the jig abuts the parting face and pushes the pair of loose cores to move away from each other for facilitating removal of the loose cores from the water jacket portion.

In another aspect of the invention, there is provided a method for producing the closed deck type cylinder block, the method comprising the steps of preparing a metal mold die for molding a substantial part of the cylinder block, the metal mold die having a die portion whose profile is the same as that of the water jacket portion for forming the water jacket portion, the die portion having a free end portion formed with a plurality of notched portions each having side walls extending in an axial direction of the cylinder liner and a bottom wall provided with a projection, preparing a plurality of pairs of loose cores, each pair being insertable into each notched portion, and each pair of loose cores having symmetrical shape and having parting faces extendible in the axial direction of the cylinder liner, each pair of loose cores having a first draft facing the bottom wall of the notched portion and a second draft which defines a part of a lower end of the water jacket portion, and a distance between the first and second drafts in the axial direction of the cylinder liner being gradually increased toward opposite circumferential direction of the water jacket portion from the parting faces, setting each pair of loose cores into each notched portion in such a manner that the parting faces extend in the axial direction of the cylinder liner and the end of the parting faces is placed on the projection of the bottom wall, injecting a molten metal into the metal mold die for forming the bridge portions at positions between the bottom wall of the notched portion and the second draft, a bore corresponding to the projection being formed in each bridge portion, inserting a jig into the bore and pressing the jig toward into the parting faces for moving the pair of loose cores away from each other from the parting faces, so that each pair of loose cores are offset from the bridge portion, and removing the thus separated loose cores from the open end of the water jacket portion.

BRIEF DESCRIPTION OF THE DRAWINGS

In the drawings;

FIGS. 6(*b*) and 6(*c*) are views for description of fitting relation between a loose core and a notched portion of a metal mold die according to several modifications to the embodiment;

FIG. 8(*b*) is a cross-sectional view taken along the line VIII—VIII of FIG. 8(*a*) for description of a conventional casting method.

DETAILED DESCRIPTION OF THE PREFERRED EMBODIMENTS

Figure 1:
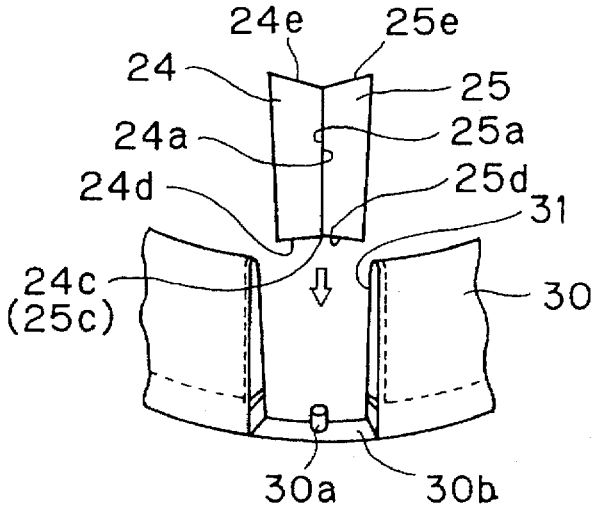
FIG. 1 is a view for description of setting a loose core into a metal mold die in a casting apparatus according to one embodiment of the present invention.
Figure 2:
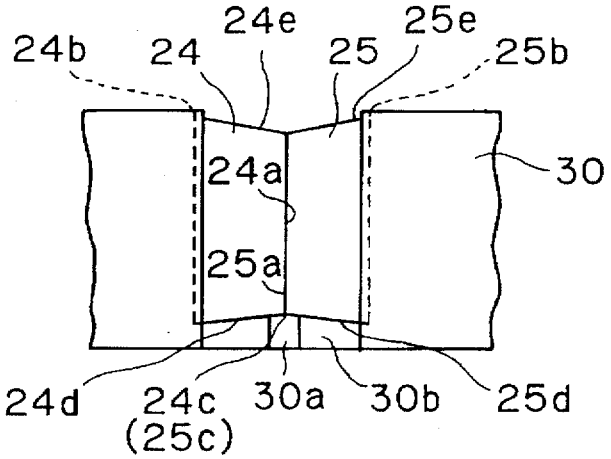
FIG. 2 is a side view showing a state where the loose core has been set into the metal mold die of the casting apparatus according to the embodiment of this invention.

A casting apparatus and casting method for producing a closed deck type cylinder block according to one embodiment of the present invention will be described with reference to FIGS. 1 through 7. A closed deck type cylinder block 1 for four cylinder in-line engine is shown in FIG. 4. The cylinder block 1 includes four cylinder liners 11 juxtaposedly disposed with each other with which pistons (not shown) are slidingly and reciprocatingly movable. A water jacket portion 10 is provided to surround the cylinder liners 11. An upper portion of the cylinder block has an attachment frame 7 or a top deck to which a cylinder head (not shown) is to be attached. The water jacket 10 is open at the attachment frame.

A plurality of bridge portions 6 are provided bridging between the attachment frame 7 and an outer area of each cylinder so as to reinforce the top deck of the cylinder block 1 and to reduce engine vibration. Thus, the open end of the water jacket 10 is partly covered with the plurality of bridge portions 6, and this structure is referred to as the closed deck type cylinder block. In a cylinder block produced in accordance with the casting device and casting method of the depicted embodiment, each bridge portion 6 is formed with a bore portion 6*a* extending through a thickness of the bridge portion 6.

A casting apparatus for producing the cylinder block 1 will be described. The casting apparatus includes a metal mold die in which a major portion of the cylinder block is molded. The metal mold die has a die portion 30 having a profile the same as that of the water jacket portion 10 for forming the water jacket portion 10. A free end of the die portion 30 is formed with a plurality of notched portion 31. Each notched potion 31 has side walls extending in an axial direction of the cylinder liner 11 and a bottom wall 30*b*. A cylindrical projection 30*a* protrudes from the bottom wall 30*b* of each notched portion 31. Protruding length of the projection 30*a* defines a thickness of the bridge portion 6.

A pair of loose cores 24, 25 are insertedly engageable with each notched portion 31. The metal mold die also includes four cylindrical protrusions each being inserted into each cylinder liner 11 concentrically with the die portion, 30 so as to prevent molten metal from being entered into a cylindrical bore space of the cylinder liner 11.

Each pair of loose cores 24, 25 provide symmetrical shape and have parting faces 24*a* and 25*a* extending in the axial direction of the cylinder liner 11. Each loose core has a first draft 24*d*, a second draft 24*e* and a first draft 25*d* and a second draft 25*e*. Each first draft 24*d*, 25*d* face the bottom wall 30*b* of the notched portion 31, and each second draft 24*e*, 25*e* define a part of a lower end of the water jacket portion 10. These drafts are slanted such that vertical distance between the first or upper draft 24*d* and the second or lower drafts 24*e* and the distance-between 25*d* and 25*e* is gradually increased toward the opposite circumferential direction of the water jacket 10 from the parting faces 24*a*, 25*a*. The term "upper" and "lower" are used when viewing the cylinder block from the upper deck surface or the attachment frame 7 shown in FIG. 4.

Figure 5:
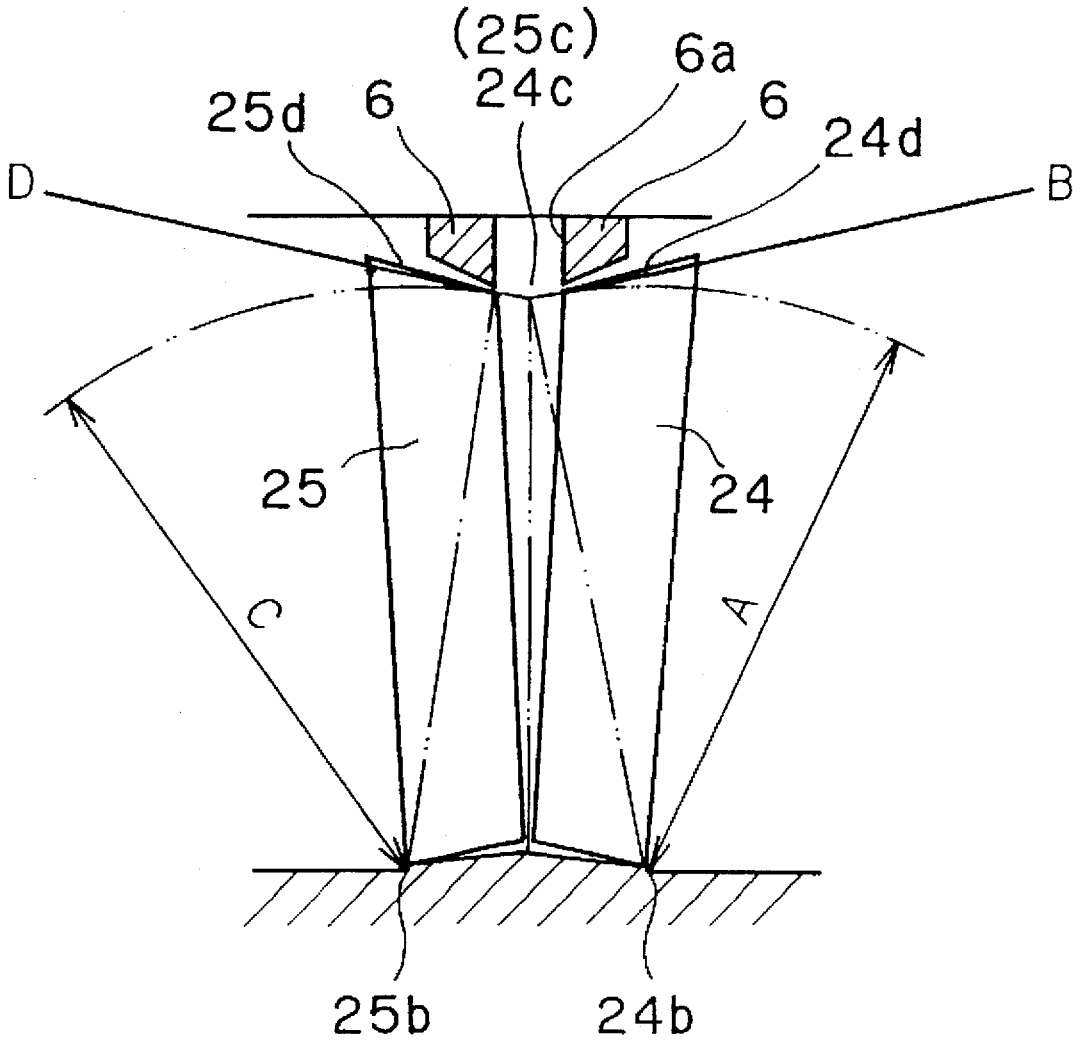
FIG. 5 is a view for description of removal of the loose core from the cylinder block in the casting apparatus according to the embodiment of this invention.

In a state where the loose cores 24, 25 are insertedly engaged with the notched portion 31, the upper draft 24*d* of the loose core 24 extends outwardly of a tangential line B shown in FIG. 5. More specifically, when a circle is drawn as shown by a two dotted chain line in FIG. 5 with a radius A bridging between an outer corner portion 24*b* and an upper inner corner portion 24*c* (upper end of the parting line 24*a*), and the tangential line B is drawn with respect to the circle and passing through the upper end 24*c*, the inclination of the upper draft 24*d* is steeper than that of the tangential line B. This is due to the following reason: The molten metal is solidified in conformance with the inclination of the upper draft 24*d*. Therefore, the lower surface of the bridge 6 has the corresponding inclination. With this state, if the loose core 24 is pivotally moved about the lower outer corner 24*b* in a clockwise direction in FIG. 5, the upper inner corner 24*c* can be moved in the circular locus shown by the two dotted chain line without mechanical interference with the solidified lower surface of the bridge portion 6. In other words, if the inclination angle of the upper draft 24*d* is smaller than that of the tangential line B, the loose core 24 cannot be angularly moved in the clockwise direction, and cannot be removed from the water jacket.

The same is true with respect to the upper draft 25*d* of the loose core 25. That is, when a circle is drawn as shown by a two dotted chain line in FIG. 5 with a radius C bridging between an outer corner portion 25*b* and an upper inner corner portion 25*c* (upper end of the parting line 25*a*), and the tangential line D is drawn with respect to the circle and passing through the upper end 25*c*, the inclination of the upper draft 25*d* is steeper,than that of the tangential line D. Thus, when the loose core 25 is pivotally moved about the lower outer corner 25*b* in a counterclockwise direction in FIG. 5, the upper inner corner 25*c* can be smoothly moved along the circular locus without mechanical interference with the lower surface of the solidified bridge portion 6.

Figure 3:
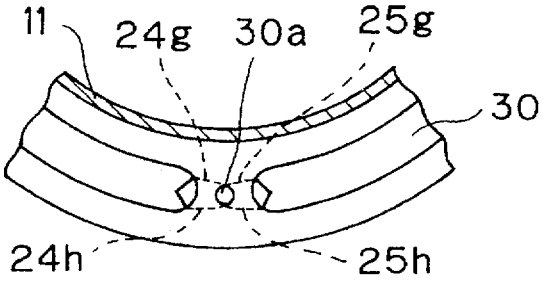
FIG. 3 is a plan view showing the state where the loose core has been set into the metal mold die of the casting apparatus according to the embodiment of this invention.
Figure 4:
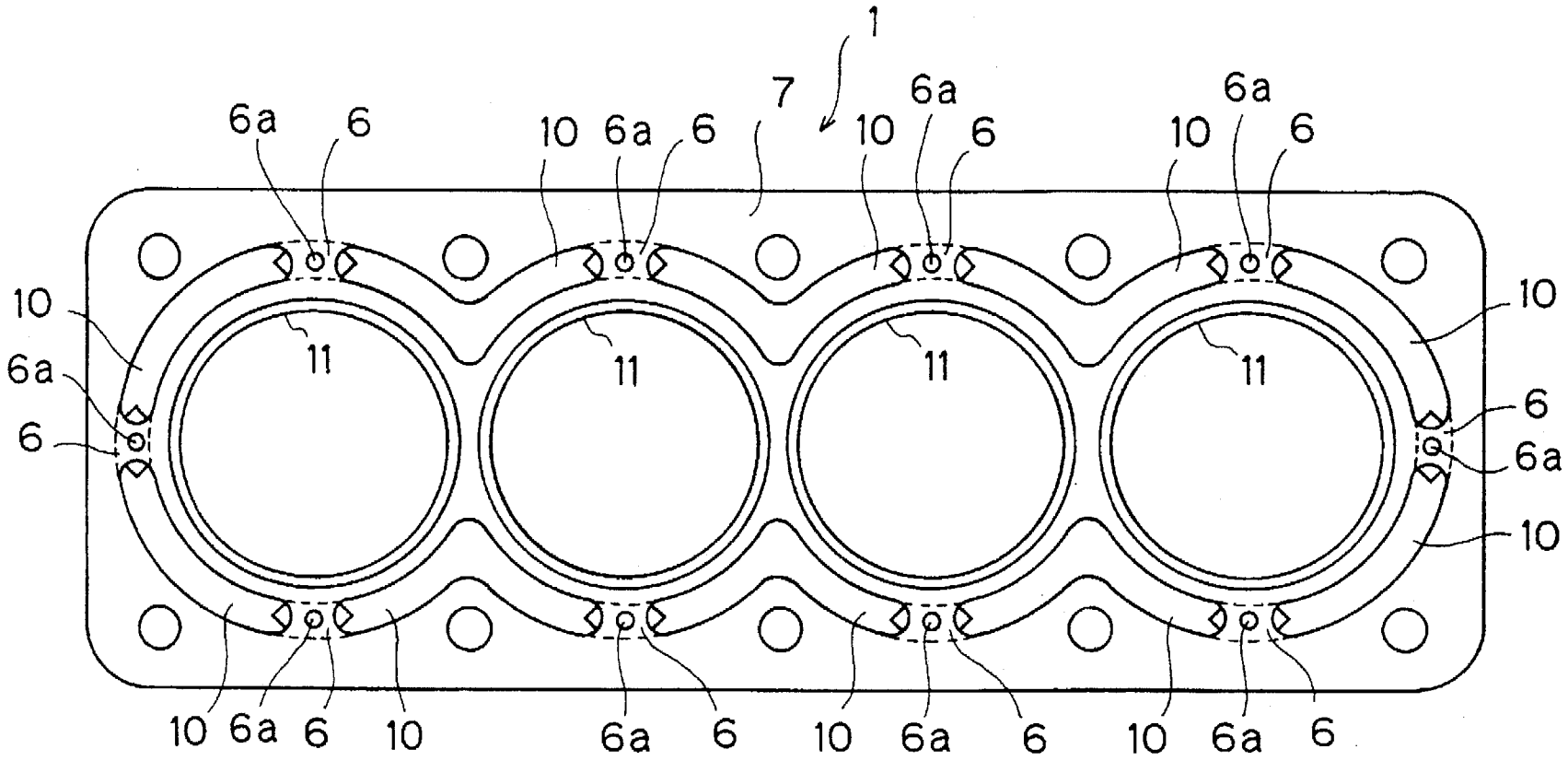
FIG. 4 is a plan view showing a closed deck type cylinder block produced by the casting apparatus and method according to the embodiment of this invention.
Figure 6:
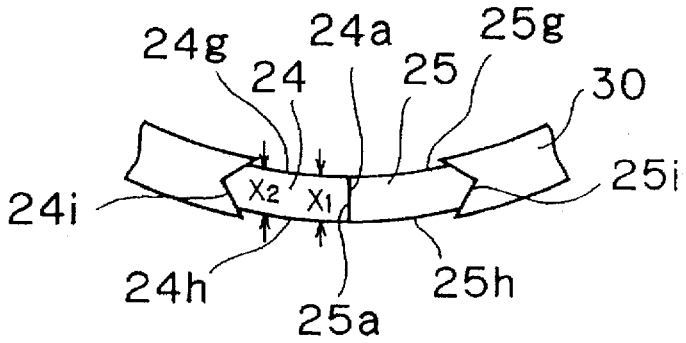
FIG. 6(*a*) is a view for description of fitting relation between a loose core and a notched portion of a metal mold die according to the embodiment.
Figure 6:
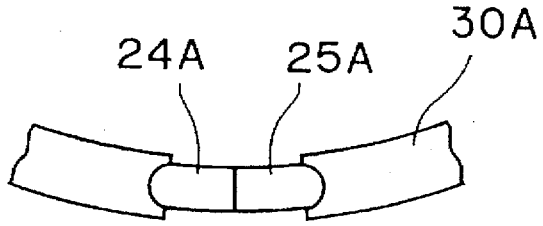
Figure 6:
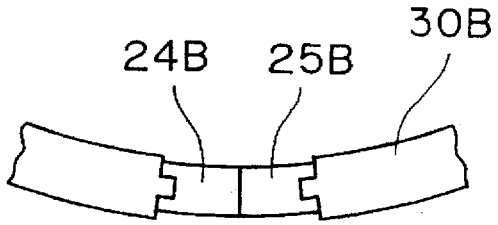

As shown in FIGS. 3 and 6(*a*), sliding drafts 24*g*, 24*h* and 25*g*, 25*h* are provided at the loose cores 24, 25. More specifically, the sliding drafts include radially outer drafts 24*h*, 25*h* and radially inner drafts 24*g*, 25*g* in a radial direction of the cylinder liner 11. A distance between the outer and inner sliding drafts 24*h* and 24*g* (or 25*h* and 25*g*) in a radial direction of the cylinder liner 11 defines a thickness of the loose core 24 or 25. Each surface of the sliding drafts is oriented such that the thickness of each loose core 24, 25 is gradually increased toward the opposite circumferential direction of the water jacket 10 from the parting faces 24*a*, 25*a*. That is, the thickness X2 is greater than the thickness X1 in FIG. 6. With this inclination of these draft surfaces, when the loose cores 24, 25 are moved away from each other within the water jacket 10 in the opposite circumferential direction, the mechanical interference between the sliding drafts and the surface of the water jacket 10 can be obviated.

Further, with respect to the surfaces 24*i*, 25*i* opposite the parting faces 24*a*, 25*a*, i.e., in the surface 24*i*, 25*i* in fitting contact with the side walls of the notched portion 31, center portions in a thickness direction of the loose cores 24, 25 protrude outwardly toward the circumferential direction of the water jacket so that the surface 24*i* and 25*i* have central apex portions. The side walls of the notched portion 31 have corresponding grooved shape configuration so as to provide mating sliding engagement with the surfaces 24*i*, 25*i*. Thus, the loose cores 24, 25 can be accurately set in the notched portion 31.

At the engaging area between the die portion 30 and the loose cores 24, 25, the thickness of the loose cores 24, 25 is smaller than the thickness of the die portion 30. Therefore, upon completion of the casting, the loose cores 24, 25 can be smoothly moved in the circumferential direction of the water jacket 10 without interference with the wall surface of the water jacket 10. If the thickness of the loose cores 24, 25 is greater than the die portion 30 which engages the loose cores, the thick loose cores cannot be moved in a narrow water jacket, and therefore, the loose cores cannot be removed from the cylinder block.

The loose cores 24 and 25 are placed on the cylindrical projection 30*a* such that the parting faces 24*a* and 25*a* are in contact with the projection 30*a*. Accordingly, a space is provided between the first drafts 24*d*, 25*d* and the bottom wall 30*b* of the notched portion 31 when the loose cores 24, 25 are insertedly set in the notched portion 31, the space being defined by the length of the projection 30*a*. Consequently, if molten metal is introduced into the space and is solidified, the bridge portion 6 is provided. Further, the projection 30*a* will provide a bore portion 6*a* of the bridge portion 6.

Next, casting process will be described. First, the parting faces 24*a* and 25*a* of the loose cores 24, 25 are brought into contact with each other, and the loose core pair is slidingly inserted into the notched portion 31 of the die portion 30 as shown in FIG. 1. In this case, the loose cores 24, 25 can be accurately set in the notched portion 31 because of the L shape engagement between the sliding surfaces 24*i*, 25*i* of the loose cores 24, 25 and the corresponding side walls of the notched portion 31. When the first drafts 24*d*, 25*d* of the loose cores 24, 25 are brought into abutment with the circular projection 30*a*, the parting faces 24*a*, 25*a* are positioned on the circular projection 30*a*. Thus, by the combination of the die portion 30 and the loose cores 24 and 25, a water jacket portion is provided.

Thereafter, the metal mold die is moved to a predetermined position so as to insert the cylindrical protrusions into the cylinder liners 11. In this case, the die portion 30 along with the loose cores 24, 25 surrounds the cylinder liners 11. Then, molten metal is introduced into the metal mold die for casting the cylinder block. In this casting, the cylinder liners 11 is surrounded by the molten metal while the water jacket portion 10 is provided around the cylinder liners 11. At the same time, molten metal is also introduced into the space between the first drafts 24*d*, 25*d* of the loose cores 24, 25 and the bottom wall 30*b* of the notched portion 31. Accordingly, a plurality of bridge portions 6 are formed at the open end of the water jacket portion 10. Incidentally, the bore portion 6*a* corresponding to the cylindrical projection 30*a* is penetratingly formed in each bridge portion 6.

Upon solidification of the molten metal, the metal mold die is opened. In this case, the loose cores 24, 25 cannot be moved together with the metal mold die, since the solidified bridge portions 6 prevents the loose cores 24, 25 from being moved. Accordingly, the side walls of the notched portion 31 of the die portion 30 are slidingly moved with respect to the engagement surfaces 24*i* and 25*i* of the loose cores 24, 25 and finally disengage therefrom while remaining the loose cores 24, 25 in the water jacket portion 10.

Next, in order to remove the loose cores 24, 25 from the cylinder block 1, a jig (not shown) is inserted into the bore portion 6*a* of the bridge portion 6 so as to pushedly move the loose cores 24, 25 away from each other as shown in FIG. 5. By pushing the jig into the bore portion 6*a*, the loose cores 24, 25 are angularly moved about the lower corner portions 24*b*, 25*b*, respectively, so that the first drafts 24*d* 25*d* of the loose cores 24, 25 are displaced from the lower surface of the bridge portion 6. As a result, the loose cores 24, 25 can be removed through the open end of the water jacket portion 10.

As described above, during pivotally moving stroke of the loose cores 24, 25, the loose cores 24, 25 are smoothly moved without interference with the bridge portion 6 because of the formation of the drafts 24*d*, 25*d*. Further, because the thickness of the loose cores 24, 25 is gradually increased toward the pivotally moving direction, and because the thickness of the loose cores 24, 25 is smaller than that of the die portion 30, the loose cores 24, 25 can be smoothly moved without interference with the wall surface of the water jacket portion 10.

FIGS. 6(*b*) and 6(*c*) show modifications with regard to the configuration of the engaging surfaces of the loose cores and the side walls of the notched portion. In the depicted embodiment shown in FIG. 6(*a*), the engaging surfaces are configured in the L or V-shaped projection (loose core side) and L or V-shaped groove (notched portion side). However, in the modification shown in FIG. 6(*b*), circular projections are formed at the loose cores 24A and 25A, and corresponding circular grooves are formed on the surface of the notched portion 30A. Alternatively, as shown in FIG. 6(*c*), rectangular grooves are formed in the loose cores 24B and 25B and corresponding rectangular projections are formed on the side walls of the notched portion 30B. In other words, each engaging surface of the loose cores having a non linear cross-section, and each side wall of each notched portion has a corresponding non linear cross-section for ensuring stationary positioning of the pair of loose cores in the notched portion.

Figure 7:
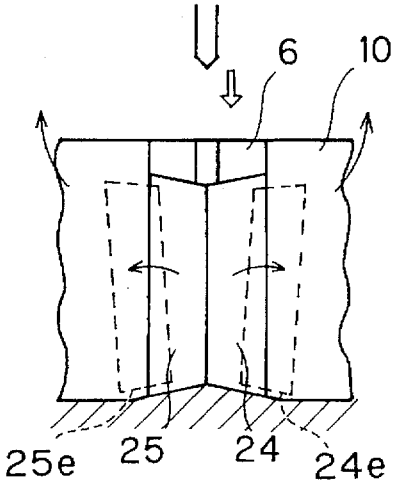
FIG. 7 is a view for description of removal of the loose core according to a modified embodiment of this invention.
Figure 8:
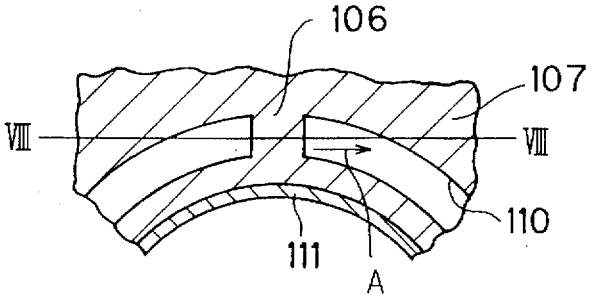
FIG. 8 (a) PRIOR ART
FIG. 8(*a*) is a plan view showing a part of a cylinder block produced by a conventional casting apparatus.
Figure 8:
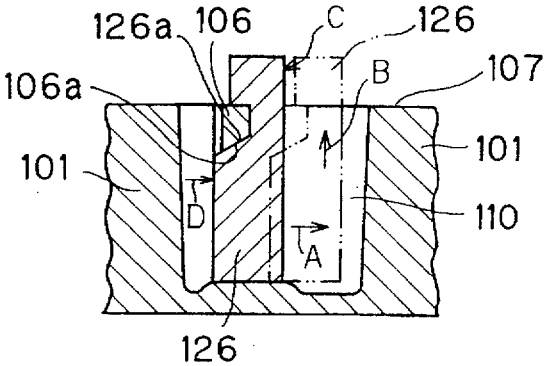
FIG. 8 (b) PRIOR ART

Further, in the illustrated embodiment, the loose cores are removed from the cylinder block 1 by their angular rotational movement about the lower corners 24*b*, 25*b* as fulcrums in opposite directions by inserting the jig moderately into the bore portion 6*a*. However, for the removal of the loose cores 24, 25, as shown in FIG. 7, the second drafts 24*e* and 25*e* of the loose cores 24, 25 can be slidingly moved on the solidified metal, which defines the bottom of the water jacket portion 10, to move the loose cores 24, 25 away from each other in parallel posture upon application of impact force, for example, high speed insertion of the jig.

While the invention has been described in detail and with reference to the specific embodiment thereof, it would be apparent to those skilled in the art that various changes and modifications may be made therein without departing from the spirit and scope of the invention.

What is claimed is:

1. A casting apparatus for producing a closed deck type cylinder block having a top deck portion and a plurality of juxtaposedly aligned cylinder liners, a water jacket portion being formed around the cylinder liners and having one open end open at the top deck portion, the open end being partly closed by a plurality of bridge portions provided at the top deck portion, the apparatus comprising:

a metal mold die for molding a substantial part of the cylinder block, the metal mold die having a die portion whose profile is the same as that of the water jacket portion for forming the water jacket portion, the die portion having a free end portion formed with a plurality of notched portions each, having side walls extending in an axial direction of the cylinder liner and a bottom wall; and a plurality of pairs of loose cores, each pair being insertable into each notched portion, and each pair of loose cores having symmetrical shape and having parting faces extending in the axial direction of the cylinder liner, each pair of loose cores having a first draft facing the bottom wall of the notched portion and a second draft which defines a part of a lower end of the water jacket portion, and a distance between the first and second drafts in the axial direction of the cylinder liner being gradually increased toward opposite circumferential direction of the water jacket portion from the parting faces.

2. The casting apparatus as claimed in claim 1, wherein each pair of the loose cores have an outer slide draft at a radially outer side thereof in a radial direction of the cylinder liner and an inner slide draft at a radially inner side of the loose core in the radial direction of the cylinder liner, a distance between the first and second slide drafts defining a thickness of each pair of the loose cores in a radial direction of the cylinder liner, the thickness of each pair of the loose cores being gradually increased toward the opposite circumferential, direction of the water jacket portion from the parting faces.

3. The casting apparatus as claimed in claim 2, wherein each bottom wall of each notched portion is formed with a projection for forming a bore portion at each bridge portion, the first draft of each pair of the loose cores being mounted on the projection in which an end of the parting faces are positioned on the projection.

4. The casting apparatus as claimed in claim 3, wherein each pair of loose cores and die portion have their thickness in a radial direction of the cylinder liner, the thickness of the loose core being smaller than that of the die portion.

5. The casting apparatus as claimed in claim 3, wherein each pair of the loose cores has engaging surfaces engageable with the side walls of each notched portion, each engaging surface of the loose cores having a non linear cross-section, and wherein each side wall of each notched portion has a corresponding non linear cross-section for ensuring stationary positioning of the pair of loose cores in the notched portion.

6. The casting apparatus as claimed in claim 5, wherein each engaging surfaces has a V-shaped projection and each side wall has a V-shaped groove engageable with the V-shaped projection when each pair of the loose cores are inserted into each notched portion.

7. The casting apparatus as claimed in claim 5, wherein each engaging surfaces has an arcuate shaped projection and each side wall has an arcuate shaped groove engageable with the arcuate shaped projection when each pair of the loose cores are inserted into each notched portion.

8. The casting apparatus as claimed in claim 5, wherein each engaging surfaces has a rectangular groove and each side wall has a rectangular projection engageable with the rectangular groove when each pair of the loose cores are inserted into each notched portion.

9. A method for producing a closed deck type cylinder block having a top deck portion and a plurality of juxtaposedly aligned cylinder liners, a water jacket portion being formed around the cylinder liners and having one open end open at the top deck portion, the open end being partly closed by a plurality of bridge portions provided at the top deck portion, the method comprising the steps of:

preparing a metal mold die fort molding a substantial part of the cylinder block, the metal mold die having a die portion whose profile is the same as that of the water jacket portion for forming the water jacket portion, the die portion having a free end portion formed with a plurality of notched portions each having side walls extending in an axial direction of the cylinder liner and a bottom wall provided with a projection;

preparing a plurality of pairs of loose cores, each pair being insertable into each botched portion, and each pair of loose cores having symmetrical shape and having parting faces extendible in the axial direction of the cylinder liner, each pair of loose cores having a first draft facing the bottom wall of the notched portion and a second draft which defines a part of a lower end of the water jacket portion, and a distance between the first and second drafts in the axial direction of the cylinder liner being gradually increased toward opposite circumferential direction of the water Jacket portion from the parting faces;

setting each pair of loose cores into each notched portion in such a manner that the parting faces extend in the axial direction of the cylinder liner and the end of the parting faces is placed on the projection of the bottom wall;

injecting a molten metal into the metal mold die for forming the bridge portions at positions between the bottom wall of the notched portion and said first draft, a bore corresponding to the projection being formed in each bridge portion;

inserting a jig into the bore and pressing the jig toward into the parting faces for moving the pair of loose cores away from each other from the parting faces, so that each pair of loose cores are offset from the bridge portion; and removing the thus separated loose cores from the open end of the water jacket portion.

10. The method as claimed in claim 9, wherein in the inserting step, the pair of loose cores are pivotally moved away from each other about each corner of the second draft.

* * * * *